US008256834B2

(12) United States Patent
Linder

(10) Patent No.: US 8,256,834 B2
(45) Date of Patent: Sep. 4, 2012

(54) PORTABLE CHAIR

(75) Inventor: Nathan Linder, West Covina, CA (US)

(73) Assignee: Innovative Displayworks, Inc., San Dimas, CA (US)

( * ) Notice: Subject to any disclaimer, the term of this patent is extended or adjusted under 35 U.S.C. 154(b) by 485 days.

(21) Appl. No.: 12/490,241

(22) Filed: Jun. 23, 2009

(65) Prior Publication Data

US 2010/0320813 A1 Dec. 23, 2010

(51) Int. Cl.
*A47C 13/00* (2006.01)
*A47C 7/62* (2006.01)

(52) U.S. Cl. ..... 297/129; 297/188.2; 297/188.06; 297/188.01

(58) Field of Classification Search ..... 297/129, 297/188.04–188.07, 188.2, 188.01; 220/480, 220/592.2, 915.2, 9.2, 9.4, 6, 666, 212
See application file for complete search history.

(56) References Cited

U.S. PATENT DOCUMENTS 3,151,909 A * 10/1964 Gerdetz ..... 297/188.2
5,354,119 A * 10/1994 Nicholas ..... 297/188.07
5,470,039 A * 11/1995 Hilger ..... 248/164
5,580,125 A * 12/1996 Alger ..... 297/250.1
5,722,717 A * 3/1998 Rettenberger ..... 297/188.1
6,000,752 A * 12/1999 Shyr ..... 297/188.08
6,048,023 A * 4/2000 Lampton ..... 297/129
6,079,599 A * 6/2000 Nordstrom et al. ..... 224/153
D438,719 S * 3/2001 Ford, Jr. ..... D6/336
6,460,925 B1 * 10/2002 Kovacs ..... 297/188.04
7,455,204 B2 * 11/2008 Lippert et al. ..... 224/275

* cited by examiner

*Primary Examiner* — David Dunn
*Assistant Examiner* — Tania Abraham
(74) *Attorney, Agent, or Firm* — Stetina Brunda Garred & Brucker

(57) ABSTRACT

A portable chair with ice chest assembly operative to interconnect with one another to create an easily-accessible beverage display, for use in display and marketing purposes, sporting events, and the like, and thereafter be collapsed to assume a space-efficient and easily transportable device. The portable chair comprises a foldable chair member operative to transition from a compact configuration to an open configuration defining supporting legs, a back rest and a seating portion. An expandable ice chest member is operative to be received upon the seating area defined by the portable chair and further preferably includes a lid member that can engage with the back rest of the portable chair. A covering may further be provided to extend about the assembled portable chair with ice chest thereon to create a compact, aesthetically pleasing beverage display.

8 Claims, 3 Drawing Sheets

PORTABLE CHAIR

CROSS-REFERENCE TO RELATED APPLICATIONS

Not Applicable

STATEMENT RE: FEDERALLY SPONSORED RESEARCH/DEVELOPMENT

Not Applicable

BACKGROUND

Portable ice chests are well-known in the art, and used extensively to store and transport refrigerated items, and chilled beverages in particular. In this regard, ice chests may be either formed from rigidly molded structures having insulated side walls or, alternatively, may be formed from sections of insulated material encased within fabric, to thus enable the ice chest to assume a folded, compact configuration when not in use.

Also well-known in the art are folding chairs or lawn chairs that are operative to be folded or collapsed to assume a first compact, easily transportable configuration, and a second unfolded or operative configuration to enable an individual to sit thereupon. Along these lines, folding chairs come in a variety of styles and configurations and are typically fabricated from wood or metal frame structures that include sections of fabric and the like that define seating areas and back rest portions.

As is further well-known, given their related use and easily transportable nature, ice chests and foldable chairs are concomitantly used with extremely high frequency. Examples of such usage include tail gate parties, youth sporting events, such as soccer, football and the like, outdoor barbecues, picnics and camping activities. In fact, the concurrent use of ice chests and folding chairs are almost obligatory for spectator events, such as tail gating parties and youth sporting events, as there is typically a need or desire refrigerated beverages that are easily and readily accessible. Indeed, it is often times practiced to have an ice chest to serve as a beverage "station" that can be easily accessed at parties or by the team participants during time-outs or breaks in the sporting events.

Ideally, it would be advantageous if a system could be provided whereby such commonly used items, namely, an ice chest and folding chair, could be operatively interconnected with one another to define an easily-accessible cooler for storing cold beverages and the like. It would further be advantageous if such a system could be designed to have easy assembly, have simple construction, and further can assume a compact, space-efficient and easily transportable configuration when not in use. There is likewise a need for such a system that can be designed that can have an aesthetically pleasing appearance that can be further utilized as a means for advertising, promotion, and the like.

BRIEF SUMMARY

The present invention specifically addresses and alleviates the above-identified deficiencies in the art. In this regard, the present invention is directed to a portable chair component with ice chest component that are operative to interconnect with one another to in essence create a beverage display whereby refrigerated items can be held within the ice chest and can be made easily and readily accessible. Moreover, the present invention is directed to such a system whereby the individual components, namely an ice chest and foldable chair, can be easily and readily disassembled and can assume compact, space-efficient and easily transportable configurations.

The portable chair component of the invention comprises a foldable chair having a frame structure defining legs, a seating area, and a back rest. Optionally, the frame will be operative to define arm rests. The portable chair component further will include panels or segments of fabric operatively integrated with the frame to define the seating portion and the back rest portion respectively. Per conventional folding chair or lawn chair design, the portable chair component of the present invention will be operative to assume a first collapsed configuration to facilitate space-efficient storage, easy handling and transportation and a second expanded configuration having the chair-like structure as defined.

The ice chest component may be fabricated from existing insulating materials known in the art, and preferably will be fabricated from fabric materials to thus enable the same to assume a space-efficient, collapsed state when not in use, but expand to define an ice chest compartment within which ice and chilled beverages may be stored. The ice chest component, however, will be sized and dimensioned so as to form a complementary fit upon the seating area defined by the portable chair component. The ice chest component will further include a strap member to facilitate interconnection with the portable chair component, and more particularly the seating area thereof. In a further refinement of the invention, the ice chest component will further include a lid component having a pocket formed thereon for receiving and forming a covering about the back rest portion of the portable chair component. In this regard, the lid portion of the ice chest component may be designed and configured to have decorative indicia to thus create an aesthetically pleasing appearance, or may otherwise be provided with advertising materials or other types of logos, such as sporting team emblems, corporate logos, and the like. Moreover, according to such preferred embodiment it is believed that the lid portion of the ice chest when configured in the manner by which the same interconnects with the back rest portion of the portable chair component will facilitate the structural integrity of the two component when the same are interconnected.

In a further refinement of the present invention, there may further be provided a cover member that is operative to extend about the portable chair and ice chest components when the two are interconnected in the aforementioned manner. In this regard, the cover member will be operative to extend over the portable chair and interconnected ice chest and will be provided with an open upper periphery having a height commensurate with the opening defined by the ice chest component by which beverages and other refrigerated items may be readily accessed. The covering member may further be provided with decorative indicia, logos, art work and the like to create a desired aesthetically pleasing appearance or as means for displaying advertising. The cover member may further be provided with slots or holes that may serve as handles to thus enable the interconnected ice chest/portable chair/cover member to be easily and readily moved as a unit.

Along these lines, the components of the present invention may further be readily disassembled and operative to transition to their space-efficient and easily-transportable configurations to thus enable the same to be easily transported and re-utilized with minimal effort.

BRIEF DESCRIPTION OF THE DRAWINGS

These and other features and advantages of the various embodiments disclosed herein will be better understood with respect to the following description and drawings, in which like numbers refer to like parts throughout.

DETAILED DESCRIPTION

The detailed description set forth below is intended as a description of the presently preferred embodiment of the invention, and is not intended to represent the only form in which the present invention may be constructed or utilized. The description sets forth the functions and sequences of steps for constructing and operating the invention. It is to be understood, however, that the same or equivalent functions and sequences may be accomplished by different embodiments and that they are also intended to be encompassed within the scope of the invention.

Figure 1:
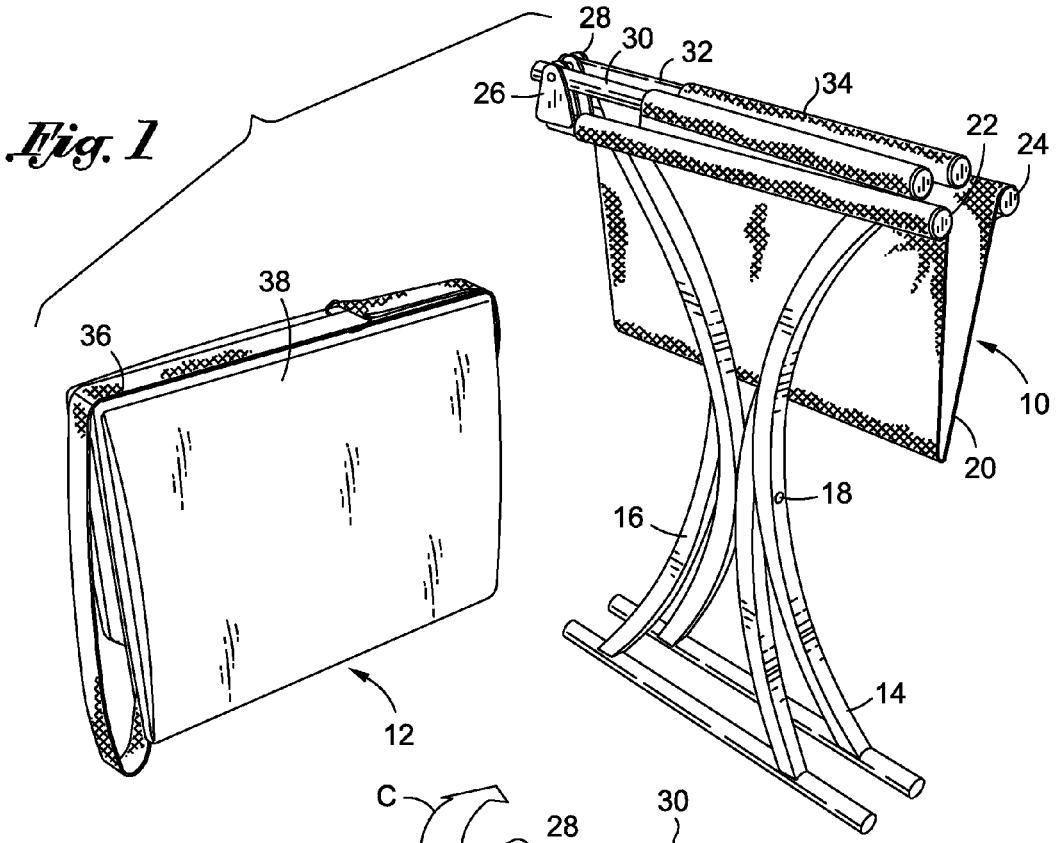
FIG. 1 is a perspective view of a portable chair component, shown assuming a first compact configuration, for use in interconnection with an ice chest as also illustrated, with the ice chest component also assuming a compact, folded configuration to facilitate handling and transportation of such device.

Referring now the figures, initially to FIG. 1, there is perspectively illustrated a system for easily and readily constructing a display cooler that enables refrigerated products, and in particular beverages, to be easily and readily accessed from an open ice chest. As illustrated, the system comprises two primary components, namely a portable chair component 10 and a collapsible ice chest component 12. With respect to the former, the same may take any of a variety of portable chair configurations known in the art that are preferably transitional between a first compact or collapsed configuration, as shown, and a second chair-like configuration operative to assume the configuration of a conventional chair and the like.

With respect to the chair component 10, the same will preferably comprise a frame member comprised of first and second leg portions 14, 16 that may be joined together via pivot or hinge 18 to thus enable the same to assume a compact configuration as shown. Along these lines, frame portions 16, 18 will be operative to provide structural support, and in particular, the legs of the chair when the same assumes its operative configuration. The chair component 10 further comprises seat frame portions 22, 24 that are affixed to frame portions 16, 18, respectively. Further provided are hinge members 26, 28 formed upon respective ones of the ends of frame portions 22, 24 to which are further affixed back rest frame portions 30, 32. To provide a seating area and a back rest area, there is preferably provided panels or fabric portions 20, 34, the former being affixed to frame sections 22, 24 and the latter being affixed to back rest frame portions 30, 32 as shown.

Figure 2:
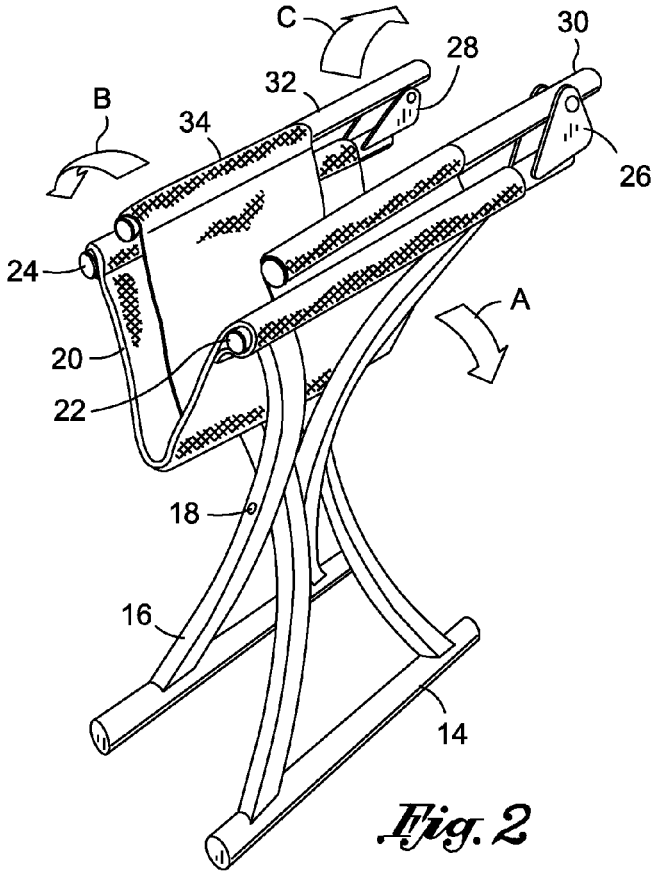
FIG. 2 is a perspective view of the portable chair of FIG. 1 shown transitioning to an expanded state to ultimately assume a chair-like configuration.

Referring now to FIG. 2, the portable chair component 10 is shown transitioning from its compact state, shown in FIG. 1, to its operative chair configuration. As illustrated, frame portions 14, 16 will rotate about hinge 18, in the directions indicated by letters "A" and "B", respectively. As a consequence, seat frame portions 22, 24 will extend away from one another to thus enable seat portion 20 to expand and define a seating area. Similarly, back rest frame portions 30, 32 will rotate about hinges 26, 28 respectively in the directions indicated by the letter "C" to thus enable the back rest panel portion 34 to assume its expanded configuration.

Figure 3:
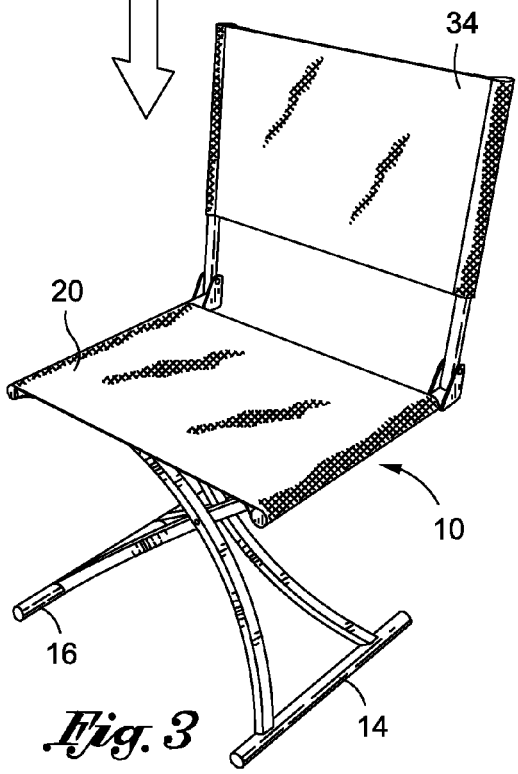
FIG. 3 is a perspective view of the portable chair and ice chest of FIG. 1 wherein both the chair and ice chest components are shown assuming expanded, operative configurations with the ice chest portion being aligned to fit and be seated upon the seating portion of the portable chair component.

Once fully expanded, as shown in FIG. 3, the portable chair component 10 will assume the conventional chair structure and maybe used as such. In this regard, frame portions 14, 16 will be operative to define chair legs and provide support to the seat 20 and back rest 34, as shown.

With respect to the ice chest component 12, as shown in FIG. 1, the same is preferably formed per any of a variety of collapsible ice chests, and preferably as may be formed from fabric and conventional thermally insulated materials. Such collapsible ice chests, which are well known in the art and extensively utilized, may further be provided with a strap member 36 operative to facilitate carrying and handling of the ice chest 12 when not in use.

Such ice chest component 12, will further be operative to assume the expanded configuration shown in FIG. 3 wherein the same defines an internal holding area 42 within which refrigerated items, and in particular chilled beverages 44 and ice may be stored. The ice chest 12, per conventional ice chests, will further be provided with lid member 38 that may form a sealable closure about opening 42 to thus provide an encapsulated and insulated compartment to prevent heat loss and conserve insulation. To facilitate and enhance the aesthetic appearance of the ice chest component 12, the lid portion 38 may be provided with a panel section 38' that may bear or may be designed to receive decorative images, logos, advertisements and the like.

Figure 4:
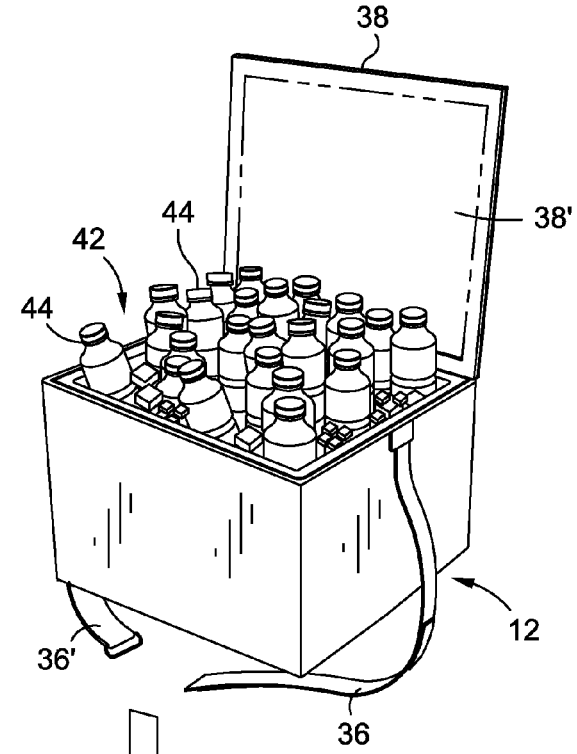
FIG. 4 is a rear perspective view of the expanded portable chair and ice chest of FIG. 3 showing the lid portion of the ice chest being positioned to engage and cover about the back rest portion of the portable chair.
Figure 4:
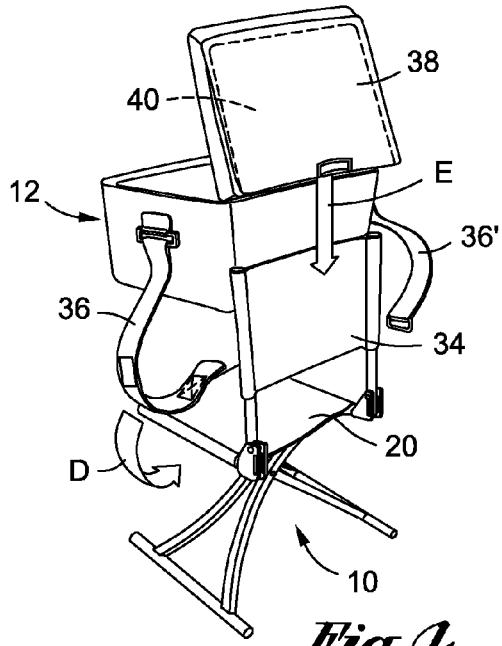
Figure 5:
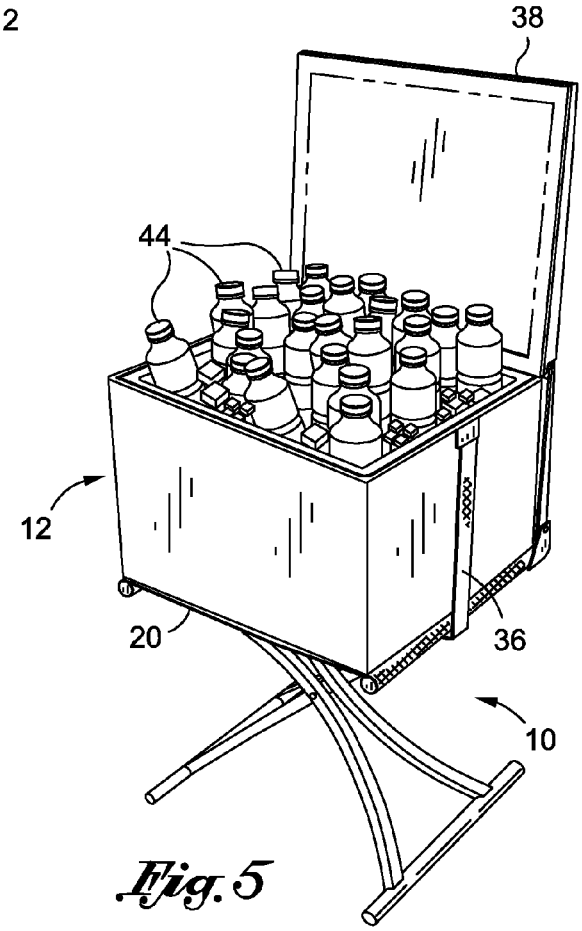
FIG. 5 is a perspective view of the portable chair with ice chest interconnected with one another such that the ice chest is operative to display and make readily accessible beverages stored therein.

As further shown in FIG. 3, the ice chest component 12 is operative to be received upon and interconnect with chair component 10, as shown. Specifically, the ice chest 12 will be specifically sized and configured to form a complimentary fit upon seating area 20 as shown. To further facilitate the interconnection between ice chest component 12 and portable chair component 10, the back rest portion 38 may further be provided with a pocket or interior portion 40, as shown in phantom in FIG. 4 that is operative to extend over backrest portion 34 as the ice chest component 12 is seated upon seating area 20. Likewise, strap 36, which may be utilized to facilitate carrying ice chest component 12 when the same assumes its compact configuration of FIG. 1, may further be utilized in the manner shown whereby the strap portion 36 will interconnect with additional strap portion 36' extending under seating portion 20 and interconnecting with one another to ultimately form the configuration shown in FIG. 5. As illustrated, ice chest component 12 is seated in alignment with seating area 20 of chair component 10 and lid portion 38 extends over backrest portion 34 (the latter not shown). Furthermore, strap member 36 is shown extending underneath and interconnecting about the seating portion 20 to thus form a stable structure between components 10, 12 and can enable beverages 44 to be readily and easily accessed as shown.

Figure 6:
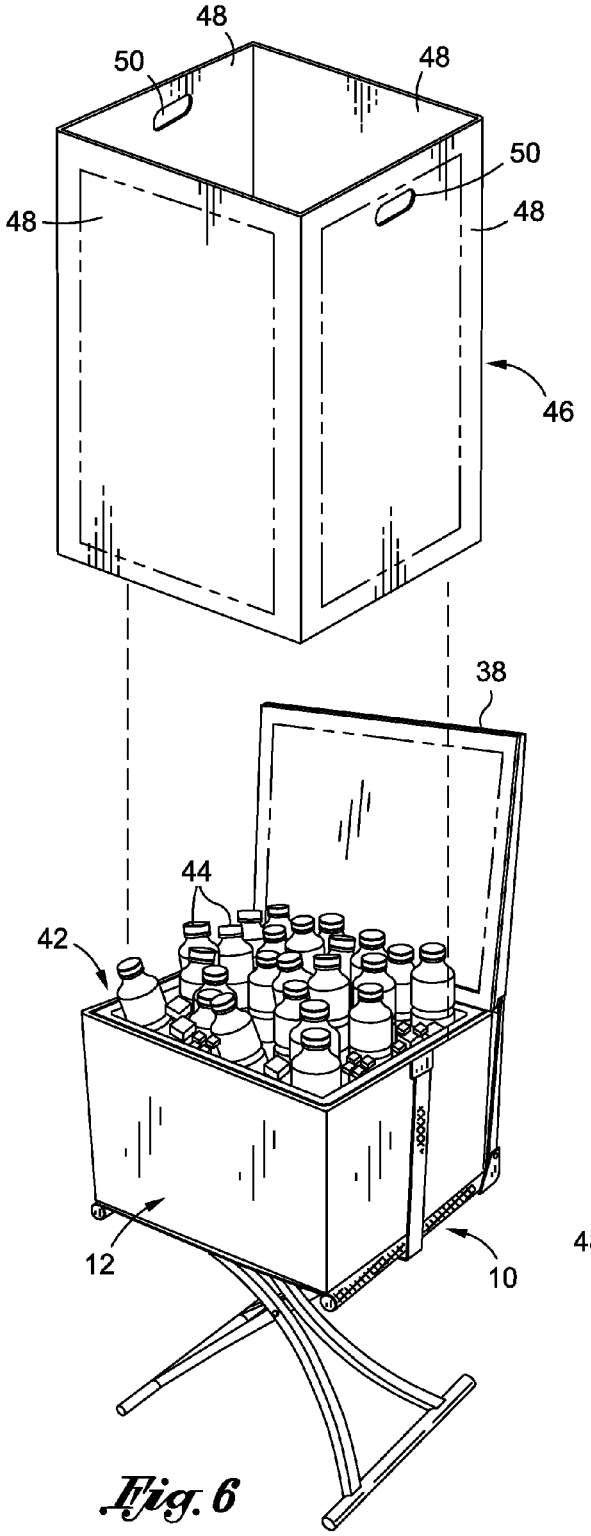
FIG. 6 is a perspective view of the portable chair with ice chest affixed thereon, as shown in FIG. 5, further showing a cover member operative to extend about the portable chair with ice chest.
Figure 7:
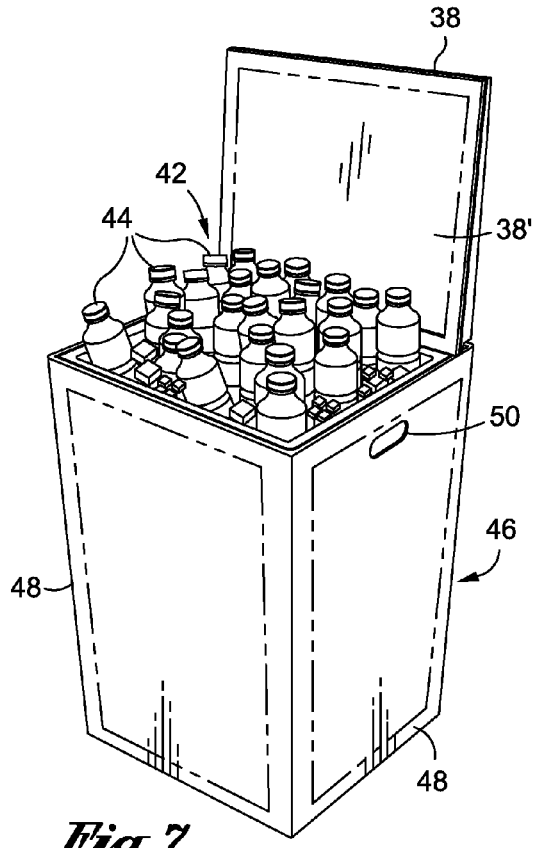
FIG. 7 is a perspective view of the portable chair with ice chest with covering member shown extending thereabout.

Referring now to FIGS. 6 and 7, and initially FIG. 6, there is shown a further enhancement of the present invention whereby a cover member 46 may further be positioned about the interconnected ice chest component 12 and portable seat component 10 while the same are shown in their operatively interconnected configurations. In this regard, cover member 46 will preferably include a plurality of side panels 48 that cooperate to form a covering that can extend over chair member 10 and will sized and configured such that the upper periphery thereof corresponds to and is contiguous with the opening 42 within which beverages 44 and ice could be stored, as shown in FIG. 7.

By interconnecting the components in the manner shown in FIG. 7, there is thus easily created a beverage display station whereby refrigerated beverages can be readily and easily accessed. To facilitate the portability of such interconnected components, the cover member 46 may be provided with openings 50, shown in FIGS. 6 and 7, that may be formed on opposed sides of the cover member 46 that can enable a user to easily pick up and transport a beverage display station in its interconnected configuration. Moreover, the side panels 48 of the cover member 46 may be designed to receive or have imprinted thereon decorative artwork, logos, advertisements and the like to thus increase its aesthetic appearance and also serve as means for promotion and advertising. Advantageously, by virtue of each of the components 10, 12 and 46 being sized and configured to interconnect with one another, the ultimate beverage display created thereby, shown in FIG. 7, is provided with an aesthetically pleasing design that can be readily and easily assembled, and can not only create a beverage display whereby refrigerated beverages are readily and easily accessible from a conventional cooler/ice chest, the same can be done in a manner that can be utilized to promote a give sports team, and in particular a youth sports team, brand of beverage or any of a variety of applications that will be well known and readily understood by those skilled in the art.

Additional modifications and improvements of the present invention may also be apparent to those of ordinary skill in the art. Along these lines, it should be understood that portable chair member 10 can take any of a variety of types of folding chairs or lawn chairs known in the art and need not encompass the specific embodiment depicted in the Figures. Likewise, ice chest component 12 need not be collapsible, but may take any of a variety of ice chests known in the art, including those that may be formed from rigid structures, and need only interconnect with the portable chair component 10 in a manner that enables the ice chest and chair to remain secure with one another. Likewise, cover member 46 may take any of a variety of shapes and sizes as may be necessary to compliment and form a covering about interconnected chair 10 and ice chest 12, and thus may not need to take a block-like configuration shown in FIGS. 6 and 7, but may be formed to have a variety of shapes and sizes, including circular, polygonal, or any of a variety of shapes and sizes as will be understood and readily appreciated by those skilled in the art. Thus, the particular combination of parts and steps described and illustrated herein is intended to represent only certain embodiments of the present invention, and is not intended to serve as limitations of alternative devices and methods within the spirit and scope of the invention.

What is claimed is:

1. A beverage display system comprising:

a portable chair component operatively transitional form a first collapsed configuration and a second expanded configuration defining a seating area and a back rest area;

an ice chest component having an open, operative configuration defining an internal holding area and open upper periphery for receiving and allowing access to ice and refrigerated items, said ice chest component being positionable upon said seating area of said chair component and securably interconnectable thereto; and a cover member extensible about said ice chest component and said portable chair component, said cover member having an open upper periphery designed to align with and forming an opening contiguous with said opening defined by said ice chest member when interconnected upon the seating area of said portable chair component.

2. The beverage display of claim 1 wherein said ice chest component is configured to be operatively transitional from a collapsed, compact configuration to said open, operative ice chest configuration.

3. The beverage display system of claim 2 wherein said ice chest further includes a strap member for interconnecting with said portable chair component when said portable chair component assumes said expanded, operative configuration.

4. The beverage display system of claim 3 wherein said ice chest component further includes a lid component having a pocket formed thereon, said pocket being sized and configured to extend over a portion of said back rest of said portable chair component when said portable chair component assumes said expanded, operative configuration.

5. The beverage display of claim 4 wherein said lid portion of said ice chest component is oriented and configured to display signage selected from the group consisting of art work, logos, and advertisements.

6. The beverage display of claim 1 wherein said cover member includes external side walls operative to receive signage selected from the group consisting of art work, logos, and advertisements.

7. The beverage display system of claim 1 wherein said cover member is further provided with at least one aperture for use in defining a handle.

8. The beverage display system of claim 7 wherein said cover member is provided with opposed apertures operative to define opposed handles for facilitating the lifting and movement of the beverage display system when said chair component, ice chest component and cover member are interconnected with one another.

* * * * *